US006245471B1

(12) United States Patent
Levin et al.

(10) Patent No.: US 6,245,471 B1
(45) Date of Patent: Jun. 12, 2001

(54) CHARGE GENERATION LAYERS COMPRISING AT LEAST ONE TITANATE AND PHOTOCONDUCTORS INCLUDING THE SAME

(75) Inventors: Ronald Harold Levin; Scott Thomas Mosier, both of Boulder, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/547,516

(22) Filed: Apr. 12, 2000

(51) Int. Cl.[7] ..... G03G 5/047

(52) U.S. Cl. ..... 430/58.4; 430/59.4; 430/59.5; 430/59.1; 430/58.8; 252/501.1

(58) Field of Search ..... 430/59.1, 59.5, 430/56, 78, 59.4, 58.4, 58.8; 252/501.1, 62.9 PZ; 106/410, 432

(56) References Cited

U.S. PATENT DOCUMENTS

| | | | | |
|---|---|---|---|---|
| 4,013,464 | | 3/1977 | Light . | |
| 4,413,047 | * | 11/1983 | Kato et al. | 430/94 |
| 5,246,610 | * | 9/1993 | Banno et al. | 252/62.9 PZ |
| 5,320,910 | * | 6/1994 | Banno et al. | 252/62.9 PZ |
| 5,464,717 | | 11/1995 | Sakaguchi et al. . | |
| 5,591,558 | * | 1/1997 | Yamazaki et al. | 430/58 |
| 6,042,980 | * | 3/2000 | Kierstein et al. | 430/59.1 |

FOREIGN PATENT DOCUMENTS 53-86219 * 7/1978 (JP) .

OTHER PUBLICATIONS

Borsenberger, Paul M. et al. Organic Photoreceptors for Imaging Systems. New York: Marcel–Dekker, Inc. pp. 190–195, 212217, 338–345, 356–361, 365–369, 1993.*
Derwent Acc. No. 1978–62805A, 1978.*
Abstract from Chemical Abstracts Plus No. JP 11084692 A2.
Abstract from Chemical Abstracts Plus No. JP 10097087 A2.
Abstract from Chemical Abstracts Plus No. JP 10073940 A2.
Abstract from Chemical Abstracts Plus No. JP 10073939 A2.
Abstract from Chemical Abstracts Plus No. JP 10312074 A2.
Abstract from Chemical Abstracts Plus No. JP 10161326 A2.
Abstract from Chemical Abstracts Plus No. JP 10069114 A2.
Abstract from Chemical Abstracts Plus No. JP 10048865 A2.
Abstract from Chemical Abstracts Plus No. JP 09304972 A2.
Abstract from Chemical Abstracts Plus No. JP 08305062 A2.
Abstract from Chemical Abstracts Plus No. JP 08305063 A2.
Abstract from Chemical Abstracts Plus No. JP 07239575 A2.
Abstract from Chemical Abstracts Plus No. JP 07168399 A2.
Abstract from Chemical Abstracts Plus No. JP 07181704 A2.
Abstract from Chemical Abstracts Plus No. JP 07175345 A2.
Abstract from Chemical Abstracts Plus No. JP 06089044 A2.
Abstract from Chemical Abstracts Plus No. JP 05158250 A2.
Abstract from Chemical Abstracts Plus No. JP 05027464 A2.
Abstract from Chemical Abstracts Plus No. JP 05181299 A2.
Abstract from Chemical Abstracts Plus No. JP 04328567 A2.
Abstract from Chemical Abstracts Plus No. JP 04195067 A2.
Abstract from Chemical Abstracts Plus No. JP 03284759 A2.
Abstract from Chemical Abstracts Plus No. JP 03185454 A2.
Abstract from Chemical Abstracts Plus No. JP 03005761 A2.
Abstract from Chemical Abstracts Plus No. JP 02156252 A2.
Abstract from Chemical Abstracts Plus No. JP 01306857 A2.
Abstract from Chemical Abstracts Plus No. DE 3919804 A1.
Abstract from Chemical Abstracts Plus No. JP 01222267 A2.
Abstract from Chemical Abstracts Plus No. JP 63228169 A2.
Abstract from Chemical Abstracts Plus No. JP 63180964 A2.
Abstract from Chemical Abstracts Plus No. JP 62164058 A2.
Abstract from Chemical Abstracts Plus No. JP 62141565 A2.
Abstract from Chemical Abstracts Plus No. JP 62041251 A2.
Abstract from Chemical Abstracts Plus No. JP 59214858 A2.
Abstract from Chemical Abstracts Plus No. JP 59009666 A2.
Abstract from Chemical Abstracts Plus No. JP 58115443 A2.
Abstract from Chemical Abstracts Plus No. US 4413047 A.
Abstract from Chemical Abstracts Plus No. JP 57158652 A2.
Abstract from Chemical Abstracts Plus No. GB 2098748 A.
Abstract from Chemical Abstracts Plus No. JP 57119353 A2.
Abstract from Chemical Abstracts Plus No. JP 56065143 A2.
Abstract from Chemical Abstracts Plus No. JP 56065144 A2.
Abstract from Chemical Abstracts Plus No. JP 53086219 A2.
Abstract from Chemical Abstracts Plus No. US 3837850 A.
Abstract from Chemical Abstracts Plus No. JP 49005469 B4.

* cited by examiner

*Primary Examiner*—Christopher Rodee
(74) *Attorney, Agent, or Firm*—John A. Brady

(57) ABSTRACT

Charge generation layers for photoconductors comprise a charge generation compound and at least one titanate which improves at least one electrical characteristic of a photoconductor in which the charge generation layer is included. Photoconductors comprise the charge generation layer in combination with a substrate and a charge transport layer.

42 Claims, 4 Drawing Sheets

CHARGE GENERATION LAYERS COMPRISING AT LEAST ONE TITANATE AND PHOTOCONDUCTORS INCLUDING THE SAME

FIELD OF THE INVENTION

The present invention is directed to charge generation layers which comprise a charge generation compound and at least one titanate. The invention is also directed to photoconductors including such charge generation layers.

BACKGROUND OF THE INVENTION

In electrophotography, a latent image is created on the surface of an imaging member such as a photoconducting material by first uniformly charging the surface and then selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner. Electrophotographic photoconductors may be a single layer or a laminate formed from two or more layers (multi-layer type and configuration).

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to use of a charge transport layer which comprises a hole transport material as the charge transport compound. One skilled in the art will appreciate that if the charge transport layer contains an electron transport material rather than a hole transport material, the charge placed on a photoconductor surface will be opposite that described herein.

When the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer comprises the charge generation compound or molecule alone and/or in combination with a binder. A charge transport layer typically comprises a polymeric binder containing the charge transport compound or molecule. The charge generation compounds within the charge generation layer are sensitive to image-forming radiation and photogenerate electron hole pairs therein as a result of absorbing such radiation. The charge transport layer is usually non-absorbent of the image-forming radiation and the charge transport compounds serve to transport holes to the surface of a negatively charged photoconductor. Photoconductors of this type are disclosed in the Adley et al U.S. Pat. No. 5,130,215 and the Balthis et al U.S. Pat. No. 5,545,499.

Typically, the charge generation layer comprises a charge generating pigment or dye (phthalocyanines, azo compounds, squaraines, etc.), with or without a polymeric binder. Since the pigment or dye in the charge generation layer typically does not have the capability of binding or adhering effectively to a metal substrate, the polymer binder is usually inert to the electrophotographic process, but forms a stable dispersion with the pigment/dye and has good adhesive properties to the metal substrate. The electrical sensitivity associated with the charge generation layer can be affected by the nature of polymeric binder used. The polymeric binder, while forming a good dispersion with the pigment should also adhere to the metal substrate.

The laser printer industry requires a tremendous range of photosensitivities which are dictated by performance constraints of a printer. For example, printers that produce an increased number of prints per minute are continually being developed. In order to produce more prints per minute, such printers operate at higher process speeds. If laser output power remains fixed, then the higher process speed means that there will be less laser energy per square centimeter available to discharge the photoconductor. As a result, photoconductors with increased sensitivities are required. Similarly, color laser printers that use a number of photoconductors in a serial arrangement typically have low output speeds because the electrophotographic process must be repeated on each drum. In order to provide color output at acceptable speeds, process speeds are increased and, in turn, increased photoconductor sensitivity is required.

Furthermore, in order to insure faithful color reproduction over the useful life of a photoconductor, the drums cannot fatigue at different rates. This is best achieved by minimizing photoconductor fatigue. As such, there is a continuing need for photoconductors exhibiting increased photoconductor sensitivity and reduced photoconductor fatigue.

SUMMARY OF THE INVENTION

Accordingly, it is an object of the present invention to provide novel photoconductors and/or novel charge generation layers which overcome disadvantages of the prior art. It is a more specific object of the invention to provide charge generation layers which improve electrical sensitivity of photoconductors. It is a further object of the invention to provide charge generation layers which minimize photoconductor fatigue. These and additional objects and advantages are provided by charge generation layers and photoconductors of the present invention. In one aspect of the present invention, the charge generation layer comprises a charge generation compound and at least one titanate. Preferably, the titanate comprises a metal titanate. Another embodiment of the present invention is directed to a photoconductor comprising a conductive substrate, a charge generation layer and a charge transport layer, wherein the charge generation layer comprises a charge generation compound and at least one titanate.

Another embodiment of the present invention is directed to a photoconductor comprising a conductive substrate, a charge generation layer and a charge transport layer, wherein the charge generation layer comprises a phthalocyanine charge generation compound, a polyvinylbutyral binder and at least one titanate.

The charge generation layers of the present invention improve electrical characteristics of photoconductors in which they are employed, for example, by reducing dark decay and/or improving sensitivity, as compared with photoconductors which contain a charge generation layer in which the charge generation layer comprises a charge generation compound in the absence of at least one titanate.

These and additional objects and advantages will be more readily apparent in view of the following detailed description.

BRIEF DESCRIPTION OF THE DRAWINGS

The present invention as set forth in the detailed description will be more fully understood when viewed in connection with the drawings in which.

DETAILED DESCRIPTION

Figure 1:
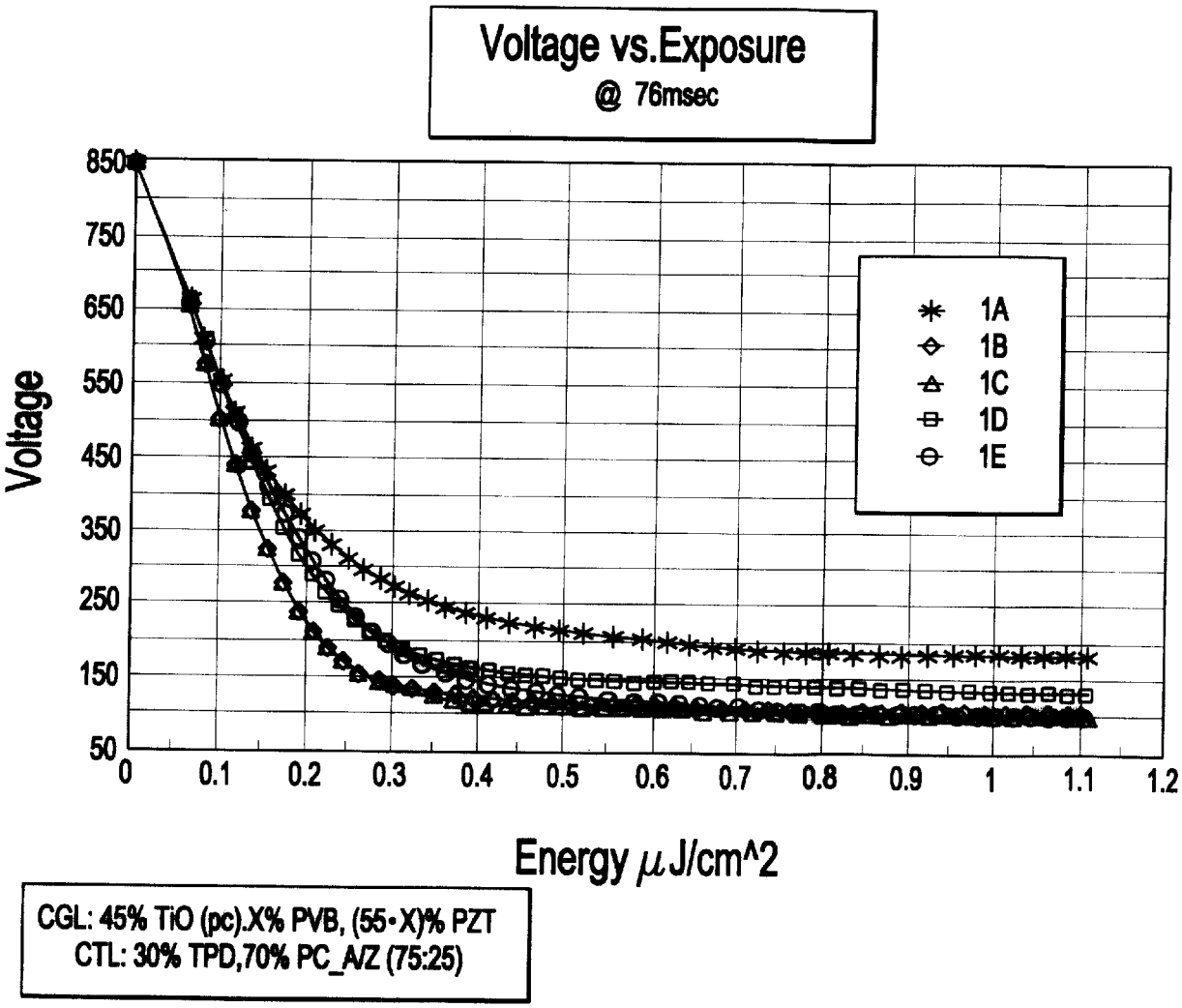
FIG. 1 sets forth electrical performance properties of a conventional photoconductor 1A wherein the charge generation layer includes a charge generation compound comprising a Type-IV titanyl phthalocyanine, as described in Example 1, and electrical performance properties of photoconductors 1B–1E according to the present invention wherein the charge generation layers include charge generation compounds comprising a Type-IV titanyl phthalocyanine and at least one titanate, as described in Example 2.

The charge generation layers according to the present invention are suitable for use in single or multi-layer photoconductors, and are particularly suitable for use in dual layer photoconductors. Dual layer photoconductors generally comprise a substrate, a charge generation layer and a charge transport layer. While various embodiments of the invention discussed herein refer to the charge generation layer as being formed on the substrate, with the charge transport layer formed on the charge generation layer, it is equally within the scope of the present invention for the charge transport layer to be formed on the substrate with the charge generation layer formed on the charge transport layer.

The present invention is directed to charge generation layers containing at least one titanate, and to photoconductors containing such charge generation layers. In one embodiment of the present invention, a charge generation layer comprises a charge generation compound and at least one titanate.

Various charge generation compounds are known in the art and are suitable for use in the present charge generation layers, including, but not limited to, phthalocyanines, squarylium compounds, azo compounds and the like. One type of charge generation compound which is particularly suitable for use in the charge generation layers of the present invention comprises the phthalocyanine-based compounds. Suitable phthalocyanine compounds include both metal-free forms such as the X-form metal-free phthalocyanines and the metal-containing phthalocyanines. In a preferred embodiment, the phthalocyanine charge generation compound may comprise a metal-containing phthalocyanine wherein the metal is a transition metal or a group IIIA metal. Of these metal-containing phthalocyanine charge generation compounds, those containing a transition metal such as copper, titanium or manganese or containing aluminum as a group IIIA metal are preferred. These metal-containing phthalocyanine charge generation compounds may further include oxy, thiol or dihalo substitution. Titanium-containing phthalocyanines as disclosed in U.S. Pat. Nos. 4,664,997, 4,725,519 and 4,777,251, including oxo-titanyl phthalocyanines, and various polymorphs thereof, for example Type-IV polymorphs, and derivatives thereof, for example halogen-substituted derivatives such as chlorotitanyl phthalocyanines, are suitable for use in the charge generation layers of the present invention.

In accordance with an important feature of the invention, the charge generation layer comprises at least one titanate, preferably an inorganic titanate. Various titanates are known in the art and are suitable for use in the present charge generation layers. In a preferred embodiment, the titanate comprises a metal titanate. Examples of suitable metal titanates include, without limitation, alkali metal titanates, e.g., sodium and potassium titanates; alkaline earth metal titanates, e.g., magnesium, calcium, and barium titanates; transition metal titanates, e.g. zinc and cadmium titanates; rare earth metal (lanthanide) titanates, e.g. neodymium titanate; and other metal titanates, e.g. aluminum and lead zirconium titanates. It is most preferred to use either lead zirconium titanate or barium titanate. Preferably, the lead zirconium titanate has a mean particle diameter of about 0.2 microns and the barium titanate has a mean particle diameter of about 0.7 microns. In addition, the lead zirconium titanate and the barium titanate have a purity greater than 99%. The present inventors have unexpectedly discovered that when at least one titanate is employed in combination with the charge generation compound, improved electrical characteristics of photoconductors in which the charge generation layers are included result. Particularly, the titanate containing charge generation layers provide the photoconductors with improved electrical characteristics such as reduced dark decay, improved sensitivity, and/or the like.

Various binder resins are known for use in charge generation layers and are suitable for use in the present invention. In one embodiment of the present invention, the binder in the charge generation layer comprises a polymeric binder. Suitable binders include, but are not limited to, vinyl polymers such as polyvinyl chloride, polyvinylbutyral, and polyvinyl acetate, polycarbonates, polyester carbonates and other conventional charge generation layer binders. More preferably, the charge generation layer comprises polyvinylbutyral. Polyvinylbutyral polymers are well known in the art and are commercially available from various sources. These polymers are typically made by condensing polyvinyl alcohol with butyraldehyde in the presence of an acid catalyst, for example sulfuric acid, and contain a repeating unit of formula (I):

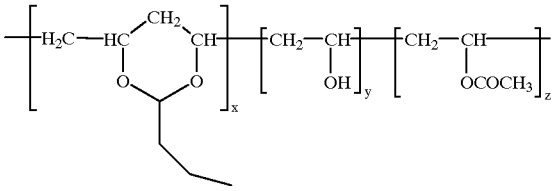

Typically, the polyvinylbutyral polymer will have a number average molecular weight of from about 20,000 to about 300,000.

The charge generation layers may comprise the charge generation compound and a polymeric binder, if included, in amounts conventionally used in the art. The titanate compound is included in an amount sufficient to improve one or more electrical characteristics of a photoconductor in which the charge generation layer is included. In another preferred embodiment of the present invention, the charge generation layer comprises from about 5 to about 99 weight percent of the charge generation compound, from about 1 to about 50 weight percent of the titanate and from about 0 to about 80 weight percent of the polymeric binder. More preferably, the charge generation layer comprises from about 30 to about 60 weight percent of the charge generation compound, from about 5 to about 35 weight percent of the titanate and from about 10 to about 55 weight percent of the polymeric binder. Even more preferred, the charge generation layer comprises from about 40 to about 55 weight percent of the charge generation compound, from about 10 to about 30 weight percent of the titanate and from about 20 to about 40 weight percent of the polymeric binder. All weight percentages are based on the weight of the charge generation layer. The charge generation layers may further contain any conventional additives known in the art for use in charge generation layers.

To form the charge generation layers according to the present invention, the polymeric binder, the charge generation compound and the titanate are typically dissolved and dispersed, respectively, in an organic liquid. Although the organic liquid may generally be referred to as a solvent, and typically dissolves the binder, the liquid technically forms a dispersion of the charge generation compound and the titanate, rather than a solution. The binder, charge generation compound and titanate may be added to the organic liquid simultaneously or consecutively, in any order of addition. Suitable organic liquids include, but are not limited to, cyclohexanone, methyl ethyl ketone, tetrahydrofuran, dioxane and the like. Additional solvents suitable for dispersing the charge generation compound, titanate and polymeric binder will be apparent to those skilled in the art.

In accordance with techniques generally known in the art, the dispersion preferably contains not greater than about 5 weight percent solids comprising both binder and charge generation compound in combination. The dispersions may therefore be used to form a charge generation layer of desired thickness, typically not greater than about 5 microns, and more preferably not greater than about 1 micron, in thickness. Additionally, because the charge generation layer comprising a polymeric binder and at least one titanate as described herein forms a stable dispersion with the charge generation compound in the organic liquid, a homogeneous layer may be easily formed using conventional techniques, for example, dip coating or the like. These dispersions also reduce any wash or leach of the charge generation compound into a charge transport layer coating which is subsequently applied to the charge generation layer.

Another embodiment of the present invention is directed to a photoconductor comprising a conductive substrate, a charge generation layer and a charge transport layer, wherein the charge generation layer comprises a charge generation compound and at least one titanate, as described above.

The photoconductor substrate may be flexible, for example in the form of a flexible web or a belt, or inflexible, for example in the form of a drum. Typically, the photoconductor substrate is uniformly coated with a thin layer of a metal, preferably aluminum, which functions as an electrical ground plane. In a further preferred embodiment, the aluminum is anodized to convert the aluminum surface into a thicker aluminum oxide surface. Alternatively, the ground plane member may comprise a metallic plate formed, for example, from aluminum or nickel, a metallic drum or foil, or a plastic film on which aluminum, tin oxide, indium oxide or the like is vacuum evaporated. Typically, the photoconductor substrate will have a thickness adequate to provide the required mechanical stability. For example, flexible web substrates generally have a thickness of from about 3 to about 20 mils, while drum substrates generally have a thickness of from about 0.5 mm to about 2.0 mm.

The charge transport layer included in the dual layer photoconductors of the present invention comprises a binder and a charge transport compound. The charge transport layer is formed in accordance with conventional practices in the art and therefore may include any binder and any charge transport compound generally known in the art for use in dual layer photoconductors. Typically, the binder is polymeric and may comprise, but is not limited to, vinyl polymers such as polyvinyl chloride, polyvinylbutyral, polyvinyl acetate, styrene polymers, and copolymers of these vinyl polymers, acrylic acid and acrylate polymers and copolymers, polycarbonate polymers and copolymers, including polycarbonate-A, derived from bisphenol A, polycarbonate-Z, derived from cyclohexylidene bisphenol, polycarbonate-C, derived from methyl bisphenol-C, polyestercarbonates, polyesters, alkyd resins, polyamides, polyurethanes, epoxy resins and the like.

Conventional charge transport compounds suitable for use in the charge transport layer of the photoconductors of the present invention should be capable of supporting the injection of photo-generated holes or electrons from the charge generation layer and allowing the transport of these holes or electrons through the charge transport layer to selectively discharge the surface charge. Suitable charge transport compounds for use in the charge transport layer include, but are not limited to, the following:

1. Diamine transport molecules of the types described in U.S. Pat. Nos. 4,306,008, 4,304,829, 4,233,384, 4,115,116, 4,299,897, 4,265,990 and/or 4,081,274. Typical diamine transport molecules include benzidine compounds, including substituted benzidine compounds such as the N,N'-diphenyl-N,N'-bis(alkylphenyl)-[1,1'-biphenyl]-4,4'-diamines wherein the alkyl is, for example, methyl, ethyl, propyl, n-butyl, or the like, or halogen substituted derivatives thereof, and the like.
2. Pyrazoline transport molecules as disclosed in U.S. Pat. Nos. 4,315,982, 4,278,746 and 3,837,851. Typical pyrazoline transport molecules include 1-[lepidyl-(2)]-3-(p-diethylaminophenyl)-5-(p-diethylaminophenyl) pyrazoline,1-[quinolyl-(2)]-3-(p-diethylaminophenyl)-5-(p-diethylaminophenyl)pyrazoline, 1-[pyridyl-(2)]-

3-(p-diethylaminostyryl)-5-(p-diethylaminophenyl) pyrazoline,1-[6-methoxypyridyl-(2)]-3-(p-diethylaminostyryl)-5-(p-diethylaminophenyl) pyrazoline, 1-phenyl-3-[p-diethylaminostyryl]-5-(p-dimethylaminostyryl)pyrazoline, 1-phenyl-3-[p-diethylaminostyryl]-5-(p-diethylaminostyryl) pyrazoline, and the like.

3. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2,4'-dimethoxybenzylidene)fluorene, 2-nitro-9-benzylidene-fluorene, 2-nitro-9-(4'-diethylaminobenzylidene)fluorene and the like.

4. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Pat. No. 3,895,944.

5. Hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone),o-methyl-p-diethylaminobenzaldehyde-(diphenylhydrazone), o-methyl-p-dimethylaminobenzaldehyde (diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos. 4,385,106, 4,338,388, 4,387,147, 4,399,208 and 4,399,207. Yet other hydrazone charge transport molecules include carbazole phenyl hydrazones such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone,9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

In a preferred embodiment, the charge transport compound of the photoconductor comprises a hydrazone charge transport compound. In another preferred embodiment, the charge transport compound of the photoconductor comprises a benzidine charge transport compound, more preferably, the charge transport compound comprises N,N'-bis(3-methylphenyl)-N,N'-bisphenylbenzidine.

The charge transport layer typically comprises the charge transport compound in an amount of from about 25 to about 75 weight percent, based on the weight of the charge transport layer, and more preferably in an amount of from about 30 to about 50 weight percent, based on the weight of the charge transport layer, with the remainder of the charge transport layer comprising the binder, and any conventional additives.

The charge transport layer will typically have a thickness of from about 15 to about 35 microns and may be formed in accordance with conventional techniques known in the art. Conveniently, the charge transport layer may be formed by dispersing or dissolving the charge transport compound in a polymeric binder and organic solvent, coating the dispersion and/or solution on the respective underlying layer and drying the coating.

In the following examples, photoconductors according to the present invention and comparative photoconductors were prepared using charge generation layers according to the present invention and conventional charge generation layers, respectively. Each of the photoconductors described in these examples was prepared by dip coating a charge generation layer dispersion on an anodized aluminum drum substrate and drying to form the charge generation layer, followed by dip coating a charge transport layer dispersion on the charge generation layer and drying to form the charge transport layer. In each photoconductor of the following examples, the charge transport layer comprised about 30 weight percent of N,N'-bis(3-methylphenyl)-N,N'-bisphenylbenzidine (TPD) and about 70 weight percent of polycarbonate binder (75/25 polycarbonate-A and polycarbonate-Z mixture-polycarbonate-A supplied by Bayer and polycarbonate-Z supplied by Mitsubishi Gas and Chemical).

The following examples demonstrate various embodiments and advantages of the charge generation layers and photoconductors according to the present invention. In the examples and throughout the present specification, parts and percentages are by weight unless otherwise indicated.

EXAMPLE 1

In this example, a comparative photoconductor 1A was prepared according to the general procedure described above. The charge generation layer (CGL) coating was prepared by adding 2.0 g of Type-IV titanyl phthalocyanine, 2.5 g of polyvinylbutyral (PVB) of a number average molecular weight, Mn, of about 98,000 g/mol, supplied by Sekisui Chemical Company under the designation BX-55Z, and 60 milliliters of glass grinding beads to 75 g of cyclohexanone in an amber glass bottle. The mixture was agitated in a paint shaker supplied by Red Devil for 13 hours. 75 g of methyl ethyl ketone (MEK) was then added to the glass bottle and the mixture was agitated for an additional 1 hour. The resulting charge generation dispersion comprised about 45 weight percent of the Type-IV titanyl phthalocyanine, about 55 weight percent of the PVB binder and generally contained about 3 percent by weight solids.

EXAMPLE 2

In this example, photoconductors 1B–1E according to the invention were prepared using the general procedure described above. The charge generation layers according to the present invention were prepared in the same manner as in Example 1, except for replacing a percentage of the PVB binder with a metal titanate. Specifically, a portion of the PVB binder was replaced with lead zirconium titanate (PZT having an average diameter of about 0.2 $\mu$m, of the approximate stoichiometric composition $PbZr_{0.6}Ti_{0.4}O_3$. The resulting charge generation dispersions comprised about 3 percent by weight solids, and were used to form charge generation layers having the compositions set forth in Table 1.

As will be apparent from Table 1, photoconductor 1A (Example 1) comprises a comparative charge generation layer in which no titanate is present, whereas photoconductors 1B–1E (Example 2) are according to the present invention and comprise a PZT containing charge generation layer

TABLE 1

| Photoconductor | % TiOPc in CGL | % PZT in CGL | % PVB in CGL |
|---|---|---|---|
| 1A | 45 | 0.0 | 55 |
| 1B | 45 | 15 | 40 |
| 1C | 45 | 25 | 30 |
| 1D | 45 | 35 | 20 |
| 1E | 45 | 45 | 10 |

EXAMPLE 3

In this example, a photoconductor 1F according to the invention was prepared using the general procedure described above. The charge generation layer according to the present invention was prepared in the same manner as in Example 1, except for replacing a percentage of the PVB binder with a metal titanate. Specifically, a portion of the PVB binder was replaced with barium titanate having an average diameter of about 0.7 $\mu$m, of the approximate stoichiometric composition $BaTiO_3$, supplied by Aldrich Chemical. The resulting dispersion comprised about 3 percent by weight solids and formed a charge generation layer comprising about 45 weight percent of the Type-IV titanyl phthalocyanine, about 30 weight percent PVB binder and about 25 weight percent $BaTiO_3$.

Various electrical characteristics of the photoconductors described in the above Examples 1 and 2 were examined. Specifically, sensitivity measurements were made using an electrostatic sensitometer fitted with electrostatic probes to measure the voltage magnitude as a function of light energy shining on the photoconductor surface using a 780 nm laser. The drum was charged by a corona and the expose-to-develop time for all measurements was 76 ms. The photosensitivity was measured as a discharge voltage on the photoconductor drum previously charged to about −850 V, measured by a light energy varying from about 0 to about 1.11 microjoules/cm$^2$.

The results of these measurements are set forth in FIG. 1 and demonstrate the surprising results that photoconductors 1B–1E according to the present invention and utilizing a charge generation layer containing the titanate PZT resulted in improved sensitivity relative to the comparative charge generation layer of photoconductor 1A which did not contain a titanate. As exhibited in FIG. 1, the discharge voltage generally decreases as a function of the percent of PZT in the CGL, thereby evidencing improved sensitivity. As further exhibited in FIG. 1, optimum sensitivity is achieved when the PVB binder and PZT were present in approximately equivalent amounts.

The photoconductors of Examples 1 and 2 were also subjected to measurement of dark decay as a function of weight percent of PVB in the charge generation layer. Dark decay is the loss of charge from the surface of the photoconductor when it is maintained in the dark. Dark decay is an undesirable feature as it reduces the contrast potential between image and background areas, leading to washed out images and loss of gray scale. Dark decay also reduces the field that the photoconductive process will experience when light is brought back to the surface, thereby reducing the operational efficiency of the photoconductor. Dark decay measurements were made with an electrostatic tester and were evaluated by charging the sample to −850V and recording the voltage drop at 1, 5, and 10 seconds.

Figure 2:
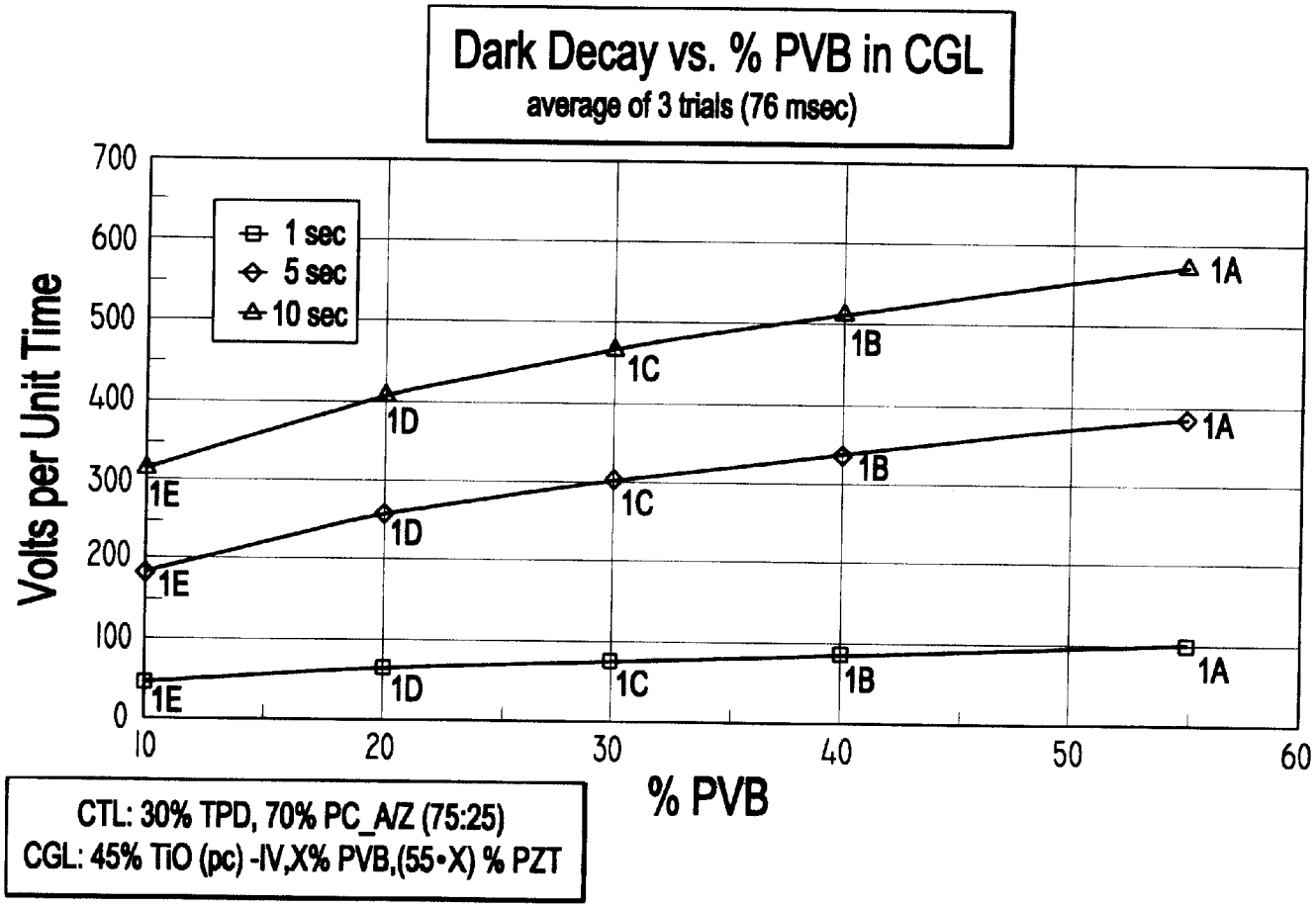
FIG. 2 sets forth additional electrical performance properties of the conventional photoconductor 1A wherein the charge generation layer includes a charge generation compound comprising a Type-IV titanyl phthalocyanine, as described in Example 1, and additional electrical performance properties of the photoconductors 1B–1E according to the present invention wherein the charge generation layers include charge generation compounds comprising a Type-IV titanyl phthalocyanine and at least one titanate, as described in Example 2.

The results of these measurements are set forth in FIG. 2 and demonstrate the surprising results that photoconductors 1B-1E according to the present invention and utilizing a charge generation layer containing the titanate PZT resulted in significant reduced dark decay as compared to the comparative charge generation layer of photoconductor 1A which did not contain a titanate. As exhibited in FIG. 2, an almost linear reduction in dark decay results as the PVB is replaced with PZT.

Figure 3:
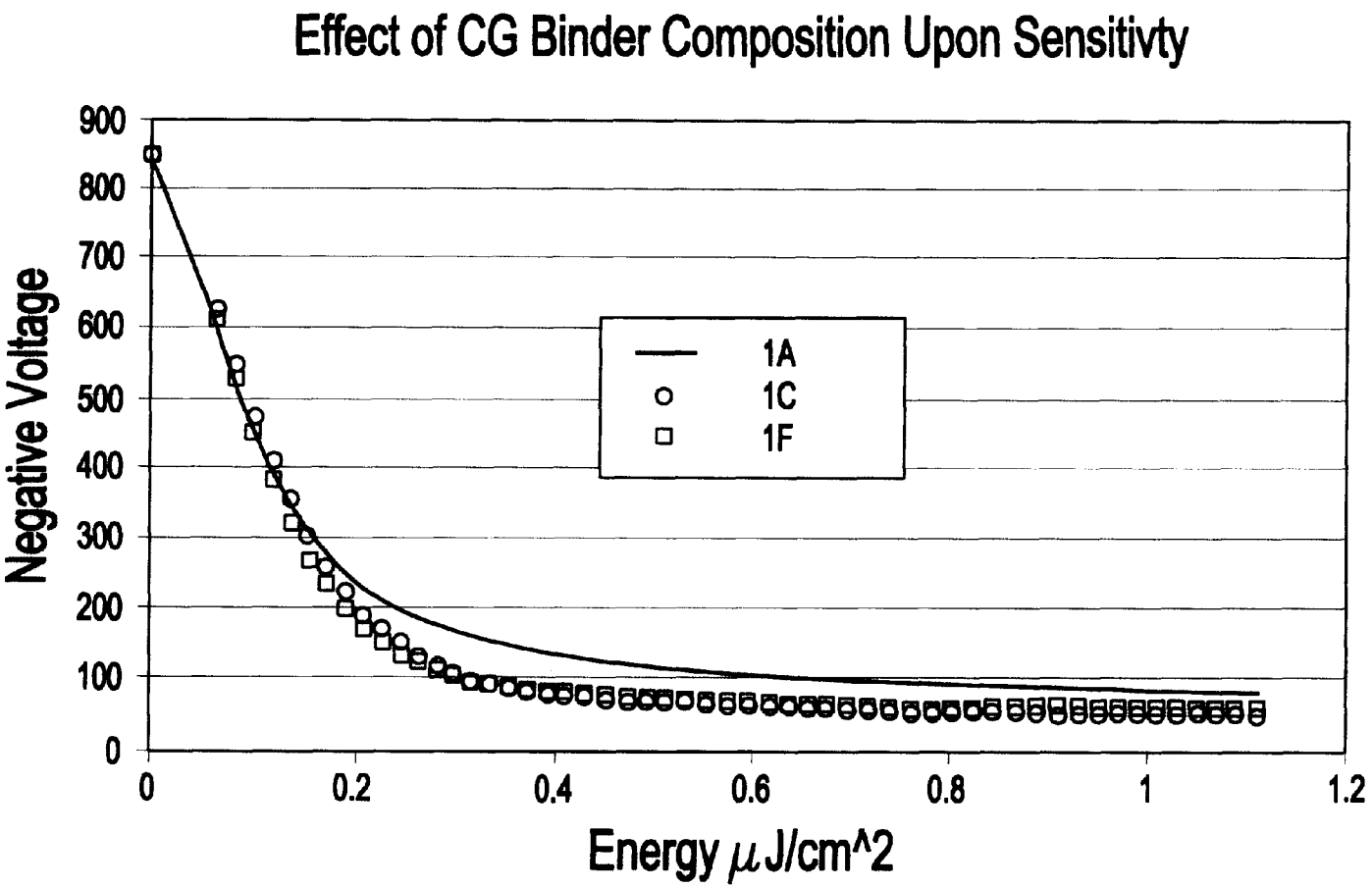
FIG. 3 sets forth additional electrical performance properties of the conventional photoconductor 1A wherein the charge generation layer includes a charge generation compound comprising a Type-IV titanyl phthalocyanine, as described in Example 1, and additional electrical performance properties of photoconductors 1C and 1F according to the present invention wherein the charge generation layers include charge generation compounds comprising a Type-IV titanyl phthalocyanine and at least one titanate, as described in Examples 2 and 3, respectively.
Figure 4:
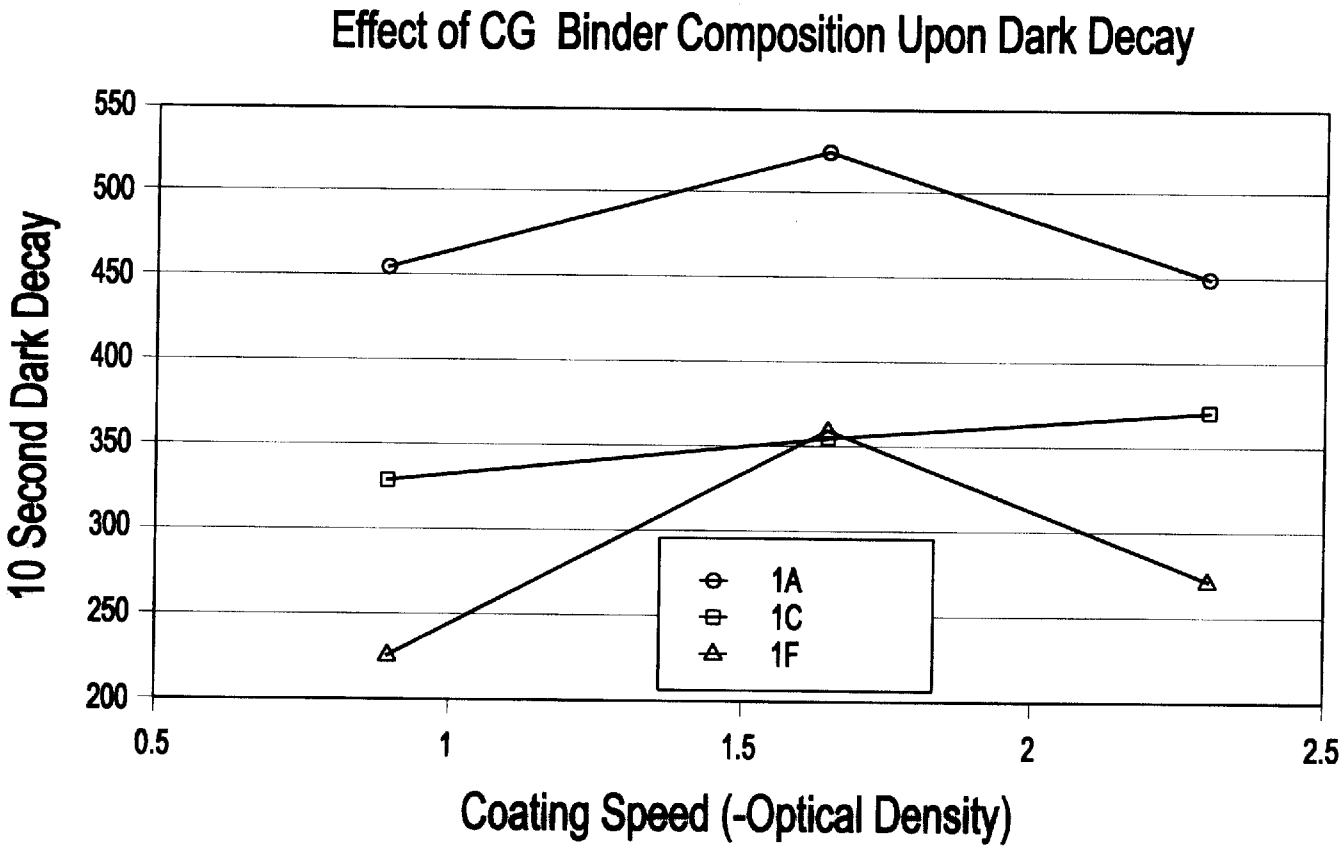
FIG. 4 sets forth additional electrical performance properties of the conventional photoconductor 1A wherein the charge generation layer includes a charge generation compound comprising a Type-IV titanyl phthalocyanine, as described in Example 1, and additional electrical performance properties of photoconductors 1C and 1F according to the present invention wherein the charge generation layers include charge generation compounds comprising a Type-IV titanyl phthalocyanine and at least one titanate, as described in Examples 2 and 3, respectively.

In addition, photoconductor 1F of Example 3 is according to the present invention and comprises a barium titanate containing charge generation layer. This photoconductor was subjected to measurement of sensitivity and dark decay in accordance with the procedures described above. The results of these measurements are set forth in FIGS. 3 and 4, respectively. For comparison purposes, comparative photoconductor 1A (Example 1—55% PVB, no titanate) and photoconductor 1C (Example 2—30% PVB+25% PZT), are included in FIGS. 3 and 4. The results as set forth in FIGS. 3 and 4 demonstrate that photoconductor 1F exhibits improved sensitivity and reduced dark decay as compared with photoconductor 1C having a similar percentage of titanate in its charge generation layer.

Thus, these examples demonstrate that the charge generation layers and photoconductors according to the present invention exhibit good electrical characteristics.

The foregoing description of the various embodiments of the invention has been presented for the purposes of illustration and description. It is not intended to be exhaustive or to limit the invention to the precise form disclosed. Many alternatives, modifications, and variations will be apparent to those skilled in the art of the above teaching. Accordingly, this invention is intended to embrace all alternatives, modifications, and variations that have been discussed herein, and others that fall within the spirit and broad scope of the claims.

What is claimed is:

1. A charge generation layer, comprising from about 30 to about 60 weight percent of a phthalocyanine charge generation compound and from about 5 to about 35 weight percent of at least one metal titanate.

2. A charge generation layer as defined by claim 1, further comprising a polymeric binder.

3. A charge generation layer as defined by claim 2, wherein the polymeric binder comprises polyvinylbutyral.

4. A charge generation layer as defined by claim 1, wherein the charge generation compound comprises a metal-containing phthalocyanine.

5. A charge generation layer as defined by claim 4, wherein the charge generation compound comprises a titanyl phthalocyanine.

6. A charge generation layer as defined by claim 1, wherein the metal titanate comprises lead zirconium titanate.

7. A charge generation layer in claim 1, wherein the metal titanate comprises barium titanate.

8. A charge generation layer as defined by claim 1, wherein the at least one titanate is included in an amount which improves photosensitivity or reduces dark decay or both, of a photoconductor in which the charge generation layer is included as compared with a photoconductor having said charge generating compound and no titanate.

9. A charge generation layer, comprising an electrophotographic charge generation compound and lead zirconium titanate.

10. A charge generation layer as defined by claim 9, further comprising a polymeric binder.

11. A charge generation layer as defined by claim 10, wherein the polymeric binder comprises polyvinylbutyral.

12. A charge generation layer as defined by claim 10, comprising from about 30 to about 60 weight percent of the charge generation compound, from about 5 to about 35 weight percent of the titanate, and from about 10 to about 50 weight percent of the polymeric binder.

13. A charge generation layer as defined by claim 9, wherein the charge generation compound comprises a metal containing phthalocyanine.

14. A charge generation layer as defined by claim 13, wherein the charge generation compound comprises a titanyl phthalocyanine.

15. A charge generation layer as defined by claim 9, further comprising a polymeric binder and wherein the charge generation compound comprises a phthalocyanine.

16. A charge generation layer as defined by claim 15, wherein the polymeric binder comprises polyvinylbutyral.

17. A charge generation layer as defined by claim 9, comprising from about 1 to about 50 weight percent of the lead zirconium titanate.

18. A charge generation layer as defined by claim 9, comprising from about 5 to about 35 weight percent of the lead zirconium titanate.

19. A charge generation layer as defined by claim 17, comprising from about 30 to about 60 weight percent of the charge generation compound and from about 5 to about 35 weight percent of the lead zirconium titanate.

20. A photoconductor, comprising a conductive substrate, a charge generation layer and a charge transport layer, wherein the charge generation layer comprises from about 30 to about 60 weight percent of a phthalocyanine charge generation compound and from about 5 to about 35 weight percent of at least one metal titanate.

21. A photoconductor as defined by claim 20, wherein the charge generation layer further comprises a polymeric binder.

22. A photoconductor as defined by claim 21, wherein the polymeric binder comprises polyvinylbutyral.

23. A photoconductor as defined by claim 21, wherein the charge generation layer comprises from about 10 to about 50 weight percent of the polymeric binder.

24. A photoconductor as defined by claim 23, wherein the charge transport layer comprises a binder and a benzidine charge transport compound.

25. A photoconductor as defined by claim 23, wherein the charge transport layer comprises a binder and a hydrazone charge transport compound.

26. A photoconductor as defined by claim 20, wherein the charge generation compound comprises a metal phthalocyanine.

27. A photoconductor as defined by claim 26, wherein the charge generation compound comprises a titanyl phthalocyanine.

28. A photoconductor as defined by claim 20, wherein the metal titanate comprises lead zirconium titanate.

29. A photoconductor as defined by claim 20, wherein the metal titanate comprises barium titanate.

30. A photoconductor as defined by claim 20, wherein the at least one titanate is included in an amount which improves photosensitivity, reduces dark decay or both of the photoconductor as compared with a photoconductor having said charge generating compound and no titanate.

31. A photoconductor, comprising a conductive substrate, a charge generation layer and a charge transport layer, wherein the charge generation layer comprises a charge generation compound and lead zirconium titanate.

32. A photoconductor as defined by claim 31, wherein the charge generation layer further comprises a polymeric binder.

33. A photoconductor as defined by claim 32, wherein the polymeric binder comprises polyvinylbutyral.

34. A photoconductor as defined by claim 31, wherein the charge generation compound comprises a metal containing phthalocyanine.

35. A photoconductor as defined by claim 34, wherein the charge generation compound comprises a titanyl phthalocyanine.

36. A photoconductor as defined in claim 31, further comprising a polymeric binder in the charge generation layer and wherein the charge generation compound comprise a phthalocyanine.

37. A photoconductor as defined by claim 36, wherein the polymeric binder comprises polyvinylbutyral.

38. A photoconductor comprising a substrate, a charge generation layer and a charge transport layer, wherein the charge generation layer comprises from about 30 to about 60 weight percent of a phthalocyanine charge generation compound, from about 10 to about 50 weight percent of a polyvinylbutyral binder and at least one metal titanate.

39. A photoconductor as defined by claim 38, wherein the metal titanate comprises lead zirconium titanate.

40. A photoconductor as defined by claim 39, wherein the metal titanate comprises barium titanate.

41. A photoconductor as defined by claim 38, wherein the charge transport layer comprises a binder and a benzidine charge transport compound.

42. A photoconductor as defined by claim 38, wherein the charge transport layer comprises a binder and a hydrazone charge transport compound.

* * * * *